US007178753B2

(12) United States Patent
Berger et al.

(10) Patent No.: US 7,178,753 B2
(45) Date of Patent: Feb. 20, 2007

(54) THREAD BRAKE

(75) Inventors: Markus Berger, Sehnde (DE); Rainer Oehl, Grossburgwedel (DE); Klaus Binder, Sarstedt (DE)

(73) Assignee: Conti Tech Luftfedersysteme GmbH, Hannover (DE)

( * ) Notice: Subject to any disclaimer, the term of this patent is extended or adjusted under 35 U.S.C. 154(b) by 0 days.

(21) Appl. No.: 10/518,852

(22) PCT Filed: May 15, 2003

(86) PCT No.: PCT/DE03/01564

§ 371 (c)(1),
(2), (4) Date: Feb. 16, 2005

(87) PCT Pub. No.: WO2004/002866

PCT Pub. Date: Jan. 8, 2004

(65) Prior Publication Data

US 2005/0184183 A1 Aug. 25, 2005

(30) Foreign Application Priority Data

Jun. 28, 2002 (DE) ..... 102 29 077

(51) Int. Cl.
*B65H 51/02* (2006.01)

(52) U.S. Cl. ..... 242/366; 242/155 R; 242/419.8

(58) Field of Classification Search ..... 242/364.11, 242/129.8, 155 R, 153, 419.5, 156.2, 365.6, 242/366, 419.8, 644.11; 139/452, 453, 194; 28/194

See application file for complete search history.

(56) References Cited

U.S. PATENT DOCUMENTS

| | | | | |
|---|---|---|---|---|
| 693,196 | A * | 2/1902 | Westphal | 242/419.2 |
| 2,093,206 | A | 9/1937 | Muller | |
| 2,159,635 | A | 5/1939 | Ranney | |
| 2,306,660 | A * | 12/1942 | Gift, Jr. | 242/418 |
| 2,717,285 | A | 9/1955 | Rayburn | |
| 2,936,877 | A * | 5/1960 | Adams et al. | 242/364.11 |
| 3,020,621 | A * | 2/1962 | Sacks | 28/240 |
| 3,113,739 | A * | 12/1963 | Elder | 242/390.8 |
| 3,183,583 | A | 5/1965 | Ostermann | |
| 3,337,930 | A * | 8/1967 | Aelion et al. | 28/221 |
| 3,872,658 | A | 3/1975 | Ostermann | |
| 3,885,604 | A | 5/1975 | Rowland | |
| 4,056,240 | A * | 11/1977 | Gallini et al. | 242/364.11 |
| 4,324,607 | A | 4/1982 | Dugger | |
| 6,053,216 | A * | 4/2000 | Debaes et al. | 139/103 |

FOREIGN PATENT DOCUMENTS

| | | |
|---|---|---|
| DE | 38 28 798 | 3/1990 |
| DE | 91 10 360 | 1/1992 |
| DE | 299 07 679 | 10/2000 |
| FR | 2 606 003 | 5/1988 |
| GB | 770037 | 3/1957 |
| GB | 921138 | 3/1963 |

* cited by examiner

*Primary Examiner*—Kathy Matecki
*Assistant Examiner*—William E. Dondero

(57) ABSTRACT

A drum brake (1) having a rotatably journalled drum (2) and means for adjusting the torque applied to the drum (2) has several peripherally-extending take-up slots (4) for filaments (5) with the slots being spaced from each other in the direction of the drum axis (X). With such an arrangement, a plurality of filaments can be adjusted to constant filament tensions simultaneously.

3 Claims, 3 Drawing Sheets

THREAD BRAKE

BACKGROUND OF THE INVENTION

The invention relates to a filament brake having a rotatably journalled drum and means for adjusting the torque applied to the drum.

In spiraling arrangements for applying a spirally-shaped filament layer, for example onto a plastic or rubber hose as a reinforcement layer or for textile machines, it is necessary to ensure a uniform filament tension in a plurality of filaments which are each pulled off of a filament spool.

A filament brake for textile machines is known from DE 299 07 679 U1 wherein an individual filament is at least partially wrapped around a bearing-mounted brake roller which is rotatably journalled. To adjust a defined filament tension, the brake torque applied to the filament brake can be adjusted with an adjusting screw. An inherent filament brake is required per filament for a plurality of filaments. A uniform adjustment of the filament tensions for the filaments cannot be ensured because each filament brake must be adjusted individually.

A bobbin creel is described in U.S. Pat. No. 2,093,206 wherein the filaments, which are pulled off a filament spool, are guided directly to a first deflecting ring and from there to a second deflecting ring. The two deflecting rings are displaceable with respect to each other in such a manner that the filament tension can be adjusted. Since the filaments of the filament spools are, however, not pulled off tangentially, the wrap-around angle changes continuously during the operation of the bobbin creel so that no uniform filament tension can be ensured.

It is therefore an object of the invention to provide a filament brake wherein a plurality of filaments can be adjusted to constant filament tensions simultaneously with respect to each other by means of an actuating variable.

SUMMARY OF THE INVENTION

The object is solved in that a plurality of take-up slots are provided for the filaments. These slots are spaced from each other in the direction of the drum axis.

According to the invention, the tension of several filaments from a common drum can be reduced or increased at the drum takeout relative to the drum intake. The filaments are preferably wrapped around the drum a number of times per take-up slot.

The torque applied to the drum or several drums is preferably synchronously adjusted by a common drive element, for example, a belt drive, chain drive or a gear train.

Alternatively, a means for adjusting the torque can be provided for each filament brake, for example, a clutch/brake combination with an electric motor.

The take-up slots have an arcuate shape when viewed in cross section. The diameter of the drum at the filament intake is greater than at the filament run out. A filament wound several times in the take-up slot is, in this way, pushed from the filament intake to the filament run out so that overwinding does not occur and a defined spring tension in the run out is built up.

The drum can be configured as a drum journalled at one end or as a shaft journalled at both ends.

In an alternate embodiment, an ancillary shaft can be mounted bordering the drum and inclined to the drum axis. The filaments each wrap around the combination of drum and ancillary shaft so that a filament is guided back from the drum via the ancillary shaft to the drum. The filament is displaced on the drum in the axial direction and an overwinding is precluded because the ancillary shaft is mounted inclined to the drum axis. In this way, the filaments are compelled to run out synchronously from the drum.

The invention will now be described in greater detail below with respect to the attached drawings.

DETAILED DESCRIPTION OF THE DRAWINGS

Figure 1:
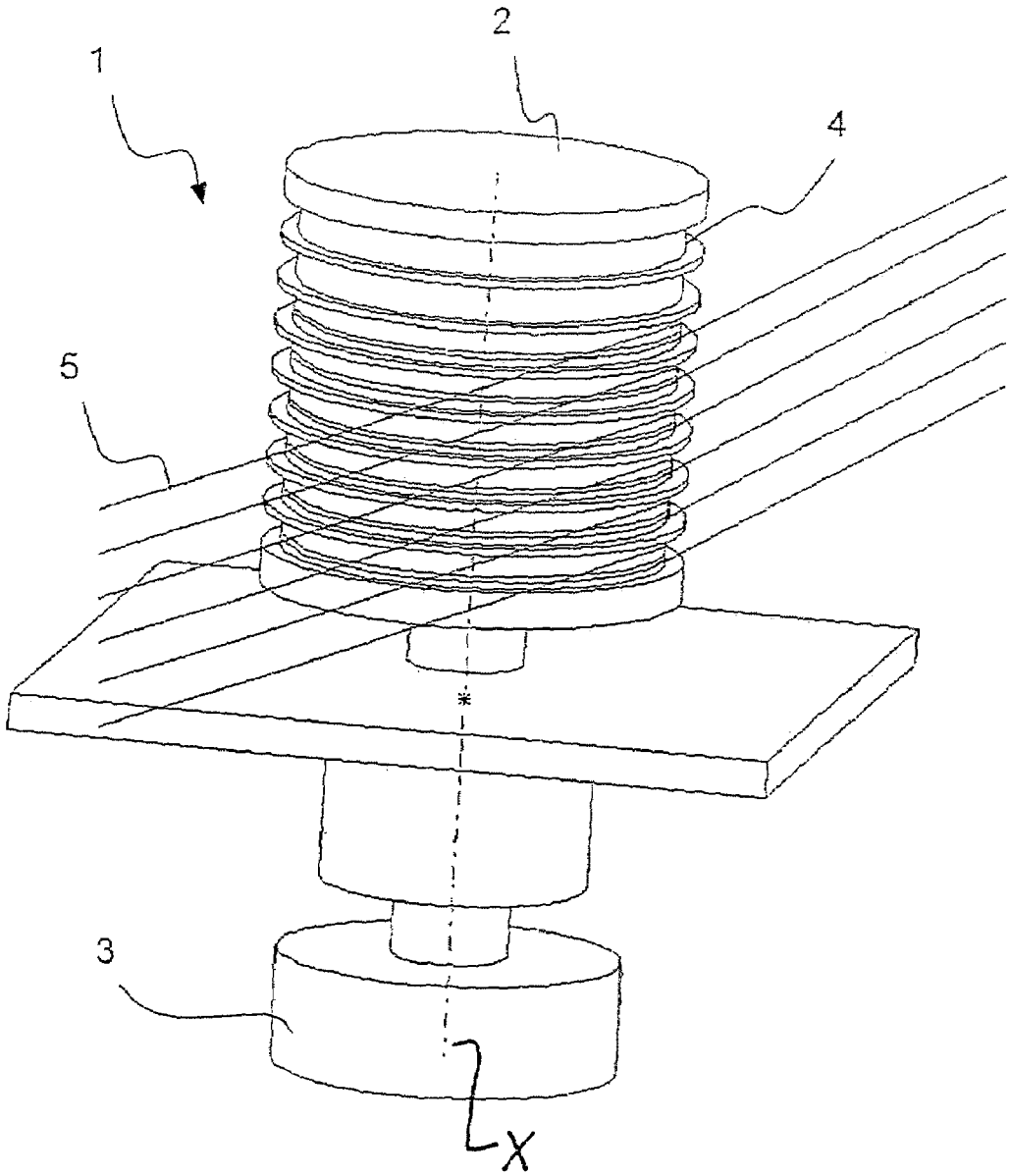
FIG. 1 shows a perspective view of a filament brake of the invention.

FIG. 1 shows a filament brake 1 in a perspective view. The filament brake essentially comprises a cylindrically-shaped drum 2 and a drive wheel 3 with means for adjusting the torque. The means for adjusting the torque can, for example, be a clutch/brake unit with an electric motor. The following can be used as transfer elements: belts, chains or gear assemblies.

According to the invention, a plurality of take-up slots 4 are provided which extend about the outer periphery of the drum 2 and each is separated from the other in the direction of the drum axis x. The take-up slots 4 run about the outer periphery of the drum 2. One filament 5 is taken up per take-up slot 4. The filament 5 is wrapped around the drum 2 several times and is placed in the take-up slot 4. In this way, a filament 5 can be driven or braked by the filament brake 1. The filament tensions of all filaments 5 of a filament brake 1 are adjusted uniformly.

In the embodiment shown, the drum 2 is journalled at one end so that the filaments 5 can be easily placed in the take-up slots 4.

Figure 2:
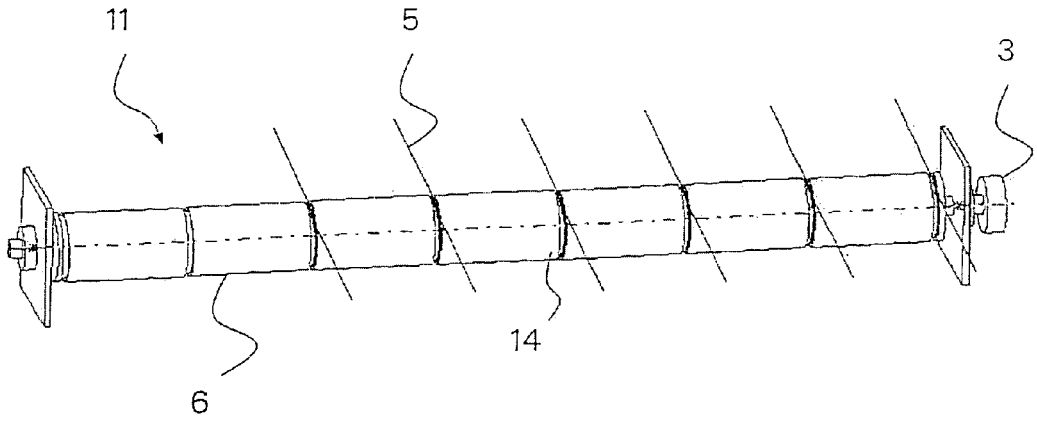
FIG. 2 shows a perspective side view of a filament brake with a drum shaft journalled at both ends.

FIG. 2 shows an embodiment of a filament brake 11. The drum is configured as a drum shaft 6 journalled at both ends. A drive wheel 3 is disposed at one end of the drum shaft 6 and this drive wheel 3 coacts with means for adjusting the torque. The receiving slots 14 are provided on the periphery of the drum shaft 6 again at a spacing from each other. The take-up slots 14 extend about the outer periphery of the drum shaft 6.

Figure 3:
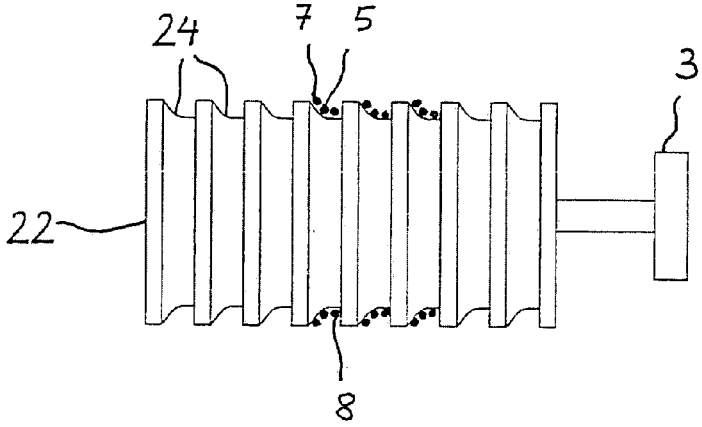
FIG. 3 is a side view of a drum having take-up slots which are profiled to have an arcuate form.

FIG. 3 shows the drum 22 in a side view. The take-up slots 4 have an arcuately-shaped profile. The filament intake 7 of the filament 5 is in the region of the larger diameter of the take-up slot 24 and the filament run out 8 is provided at the lower diameter so that the filament 5 migrates axially with the rotation of the drum 2 in the direction of the smaller diameter of the take-up slot 24. In this way, overwindings are avoided and a uniform filament tension develops.

Figure 4:
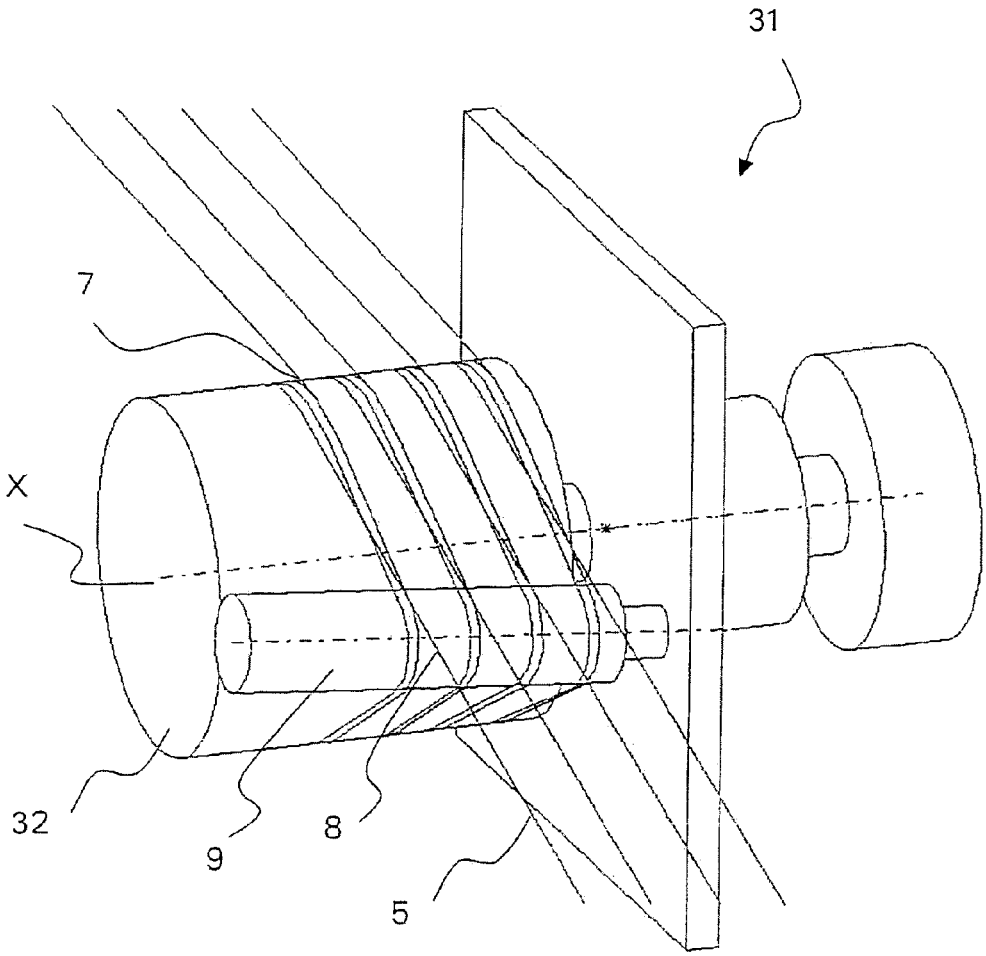
FIG. 4 shows a perspective view of a filament brake having an additional shaft.

FIG. 4 is another embodiment of the filament brake 31. An ancillary shaft 9 is provided adjacent to the drum 32 and inclined to the drum axis X. The filaments 5 each wrap around the combination of the drum 32 and the ancillary shaft 9 and are placed over both the drum 32 and the ancillary shaft 9 as shown. Because of the ancillary shaft 9, which is arranged inclined to the drum 32, the filaments 5 are placed axially on the drum 32 so that, in turn, the filaments migrate axially from the filament intake 7 to the filament run out 8. Overwindings are avoided and a unitary filament tension is formed.

The invention claimed is:

1. A filament brake comprising:

a rotatably journaled drum defining a drum axis (X);

said drum having a plurality of peripherally-extending take-up slots formed thereon for accommodating a plurality of filaments therein, each filament taking up one slot and being wound around the drum several times;

said take-up slots being spaced one from the other in the direction of said drum axis (X); and a drive wheel adapted to cooperate with means for adjusting the torque of said drum, wherein each of said slots has an arcuate shape viewed in cross section and includes a filament intake region and a filament run-out region axially offset from each other; said drum having a first diameter at each intake region and a second diameter at each run-out region; and, said first diameter is greater than said second diameter.

2. The filament brake of claim 1, wherein the drum is journaled at one end.

3. The filament brake of claim 1, wherein the drum is a shaft journaled at both ends.

* * * * *